US008876505B2

(12) United States Patent
Nachtergaele et al.

(10) Patent No.: US 8,876,505 B2
(45) Date of Patent: Nov. 4, 2014

(54) ROTOR FOR A SCREW COMPRESSOR

(75) Inventors: Johan Nachtergaele, Brasschaat (BE); Richard Andre Maria De Bock, Sint-Gillis Waas (BE); Simon Peter G. De Bock, Stekene (BE)

(73) Assignee: Atlas Copco Airpower, Wilrijk (BE)

( * ) Notice: Subject to any disclaimer, the term of this patent is extended or adjusted under 35 U.S.C. 154(b) by 175 days.

(21) Appl. No.: 13/266,551

(22) PCT Filed: Jun. 7, 2010

(86) PCT No.: PCT/BE2010/000043
§ 371 (c)(1),
(2), (4) Date: Oct. 27, 2011

(87) PCT Pub. No.: WO2010/142003
PCT Pub. Date: Dec. 16, 2010

(65) Prior Publication Data

US 2012/0045356 A1 Feb. 23, 2012

(30) Foreign Application Priority Data

Jun. 10, 2009 (BE) ..... 2009/0352

(51) Int. Cl.
*F01C 1/16* (2006.01)
*F04C 18/16* (2006.01)
*F04C 29/04* (2006.01)
*F04C 29/00* (2006.01)

(52) U.S. Cl.
CPC ..... *F04C 18/16* (2013.01); *F04C 29/04* (2013.01); *F04C 29/0042* (2013.01)
USPC ..... 418/201.1; 418/270; 418/197

(58) Field of Classification Search
USPC ..... 418/83, 91, 94, 98, 102, 197, 201.1, 418/201.2, 270
See application file for complete search history.

(56) References Cited

U.S. PATENT DOCUMENTS

| | | | | |
|---|---|---|---|---|
| 7,150,611 | B2 * | 12/2006 | Perna | 418/201.1 |
| 7,510,380 | B2 * | 3/2009 | Alam et al. | 416/244 R |
| 7,993,118 | B2 * | 8/2011 | Prior et al. | 418/91 |
| 8,192,186 | B2 * | 6/2012 | Moens | 418/94 |
| 2008/0031761 | A1 * | 2/2008 | North | 418/83 |

FOREIGN PATENT DOCUMENTS

| | | |
|---|---|---|
| DE | 2354822 | 5/1975 |
| JP | 64383 | 1/1989 |

OTHER PUBLICATIONS

International Search Report in PCT/BE2010/000043, Sep. 28, 2010.

* cited by examiner

*Primary Examiner* — Thai Ba Trieu
*Assistant Examiner* — Thomas Olszewski
(74) *Attorney, Agent, or Firm* — Bacon & Thomas, PLLC

(57) ABSTRACT

Rotor for a screw compressor includes a rotor body (2) and a shaft (6), whereby said shaft extends at least with a part into or through a central or approximately central axial bored hole or passage (5) in the rotor body (2). The shaft (6) has a stretch element (7), whereby the rotor body (2) or at least a part thereof is held on the shaft (6) by means of tension elements (11 and 12) which are locked or can be locked axially with respect to the shaft and which are connected with each other by means of the stretch element (7). During the mounting of the rotor body (2) on the shaft (6), the stretch element is pre-tensioned by means of a tensile load and after locking the tension elements (11 and 12) and removal of the tensile load, is kept under an axial pretension which, in case the rotor (1) is not built in, amounts to at least thirty percent of the yield strength of the material of the stretch element (7), and this by means of the tension elements (11 and 12) which are kept apart from each other by the rotor body (2) or a part thereof.

32 Claims, 11 Drawing Sheets

ROTOR FOR A SCREW COMPRESSOR

BACKGROUND OF THE INVENTION

1. Field of the Invention

The present invention relates to a rotor for a screw compressor.

2. Related Art

As is known, a screw compressor is equipped with a drive, typically in the shape of a motor, and with a screw compressor element comprising a casing having therein two meshing rotors, whereby one of said rotors, whether or not through a transmission, is driven by the aforementioned drive.

Due to the meshing of the rotors, during the operation of the screw compressor, a fluid, such as air, is sucked in at the inlet of the screw compressor element, which fluid is then compressed between both rotors and is finally expelled at the outlet side of the compressor element under a certain outlet pressure.

The meshing screw shaped parts of the rotors are referred to as the rotor bodies. As is known, one of the rotors has the shape of a male rotor with lobes, while the other rotor has the shape of a female rotor with grooves, in which the lobes of the male rotor mesh in a known manner.

In order to be able to drive the rotors, the rotor bodies are typically provided with a journal on at least one end.

Leakage losses involve a reduction of the efficiency of the screw compressor. To limit these leakage losses, the clearance between the rotors and the clearance between the rotors and the casing of the screw compressor must be kept as small as possible.

Furthermore, in order to prevent damage, any direct contact between the rotor bodies and the casing of the screw compressor is preferably avoided, such that the rotor must not only be strong enough, but also rigid enough.

For this reason, rotors for screw compressors are traditionally manufactured as a single part.

A drawback of this is that material is lost during production.

Another drawback of such single part rotors is that the entire rotor, i.e., both the rotor body and the journals, must be manufactured from the same material.

However, different parts of the rotor pose different requirements to the material to be used.

The possible journals must transmit large forces and must have a very robust bearing.

It is practically impossible to use the journal itself as an inner ring of a bearing. To do so not only necessitates a special type of steel, but also requires a special finishing of the corresponding journal. However, it is not evident to manufacture the entire rotor from such a special type of steel due to reasons of a more difficult processing of such material and the costs involved therein.

The rotor body of a rotor for a screw compressor is preferably made as lightweight as possible. This is desirable because of the high number of revolutions of the rotor during operation of the screw compressor.

Depending on the built-in pressure ratio of the compressor element, the fluid sucked in may heat up strongly during the compression. A fraction of this heat is discharged through the rotor by means of convection. Consequently, the temperature of the rotor may rise very high locally. Also when such relatively high temperatures occur, the strength and the rigidity of the rotors must still be guaranteed.

A material with a low thermal expansion coefficient must be chosen for the rotor body in order to avoid contact with the casing and to reduce leakage losses at the same time.

Another drawback of a single-piece rotor is that it is difficult to provide a suitable cooling channel therein. Although it is possible to provide a central cooling channel through the entire rotor, the cooling efficiency will be limited.

Indeed, the dimensions of the cooling channel may not result in a substantial weakening of the structure. This results in the distance between the cooling channel introduced and the outer surface of the rotor becoming too large to obtain efficient cooling.

Yet another drawback is that it is difficult or even impossible to repair a rotor when only a single part, such as the journal or the rotor body, is damaged.

It is also disadvantageous that placing sensors in the rotor, for example for measuring vibrations or temperature, is difficult.

From the foregoing, it is clear that single-piece rotors for screw compressors have a series of drawbacks.

Therefore, the present invention aims to offer a solution for at least one of said and/or other drawbacks.

SUMMARY OF DISCLOSURE

To that end, the invention provides a rotor for a screw compressor, which rotor comprises a rotor body and a shaft, whereby said shaft extends at least with a part into or through a central or approximately central axial bored hole or passage in said rotor body, whereby according to the specific feature of the invention, said shaft comprises a stretch element, whereby the rotor body or at least a part thereof is retained on the shaft by means of tension elements which are locked or can be locked axially with respect to the shaft and which are interconnected by means of said stretch element which, during the assembly of the rotor body on the shaft, is pre-tensioned by means of tensile load and after locking said tension elements and removing the tensile load, is kept under an axial pre-tension which, when the rotor is not built in, amounts to at least thirty percent of the yield strength of the material of the stretch element, and this by means of said tension elements which are kept apart by the rotor body or a part of it.

Hereby, the rotor not being built in has the meaning of the rotor being assembled but not being built-in into a compressor element. As such, it involves a condition wherein no gas forces or any other forces are exerted on the rotor and wherein this rotor is in environmental conditions (for example room temperature, atmospheric pressure, . . . ).

The yield strength of a material is also referred to in the literature as the yield point of this material.

A first advantage which is obtained by the separate manufacturing of the rotor body and the shaft is that there is a less loss of material during production.

Another advantage is that the tensile pre-tensioning with which the rotor body is retained on the shaft is precisely known and can be measured because during the assembly of a rotor body on the shaft, only tensile tensions are formed and, accordingly, unwanted and uncontrolled tensile stresses cannot arise, for example, as a consequence of the phenomenon of thread friction that may be present in the cases in which the rotor body is fixed on the shaft by means of a tensioning bolt which is fastened with a preset torque to cause a determined tensile stress. Such thread friction is very difficult to control and depends on many parameters, such as the lubrication of the bolt, the temperature during assembly which affects the expansion of the components, the manufacturing tolerances of the bolt and the like, such that for a certain tensioning torque a certain margin of error on the resulting tensile stress should be taken into account.

Another advantage is that different materials can be used for the rotor body and for the shaft in order to take into account the mechanical and thermal load of the different parts of the rotor.

As such it is possible, for example, to manufacture the journals of a rotor from steel to obtain a favorable bearing, whereas the rotor body is manufactured from another material.

Manufacturing the rotor body from for example stainless steel or bronze, results in a rotor body very resistant to corrosion.

Cast iron can be appropriate if the price is of paramount importance. The use of ceramic materials or glass offers high resistance to temperature and a low expansion coefficient. Aluminium offers the advantage that a product with a low weight is obtained. Different types of organic or inorganic materials, such as synthetic materials, whether or not fiber reinforced, could also be used for the manufacturing of the rotor body.

Of course the rotor body can also be made of steel. In that case, it is even possible to select another treatment or another type of steel than for the shaft.

It is clear that other materials can also be used to manufacture the different components, such as the journals, the stretch element and the rotor body for example.

According to the invention, it is also possible for the rotor body, for example, to be manufactured from different materials, as will be described below with reference to the drawings.

Yet another additional advantage is that a defective part, such as a damaged journal or a damaged face of a rotor body, can be repaired or replaced more easily. In this case, it is not necessary anymore to replace the whole rotor is the case for single-piece rotors.

Special attention must be paid to the major advantages provided by a composed rotor with respect to its cooling. This will be explained in further detail in the description with reference to the drawings.

The present invention also provides a method for producing a rotor as described above, this method comprising the steps of

- providing a central or approximately central axial bored hole or passage in a rotor body;
- placing at least part of a shaft in this bored hole or passage, whereby said shaft comprises a stretch element;
- loading the stretch element under tensile stress in order to pre-stress this stretch element;
- placing tension elements on both sides of the stretch element which interconnects the tension elements, which tension elements are locked or can be locked axially with respect to the shaft in a position such that after removing the tensile load, they will be kept apart by the rotor body or a part thereof and thereby keep the stretch element under pre-stress.

DESCRIPTION OF DRAWINGS

In order to better explain the characteristics of the present invention, the following preferred embodiments of a rotor according to the invention for a screw compressor are represented by way of example only and without being limitative in any way, with reference to the accompanying drawings, in which.

DETAILED DESCRIPTION OF PREFERRED EMBODIMENTS OF THE INVENTION

Figure 1:
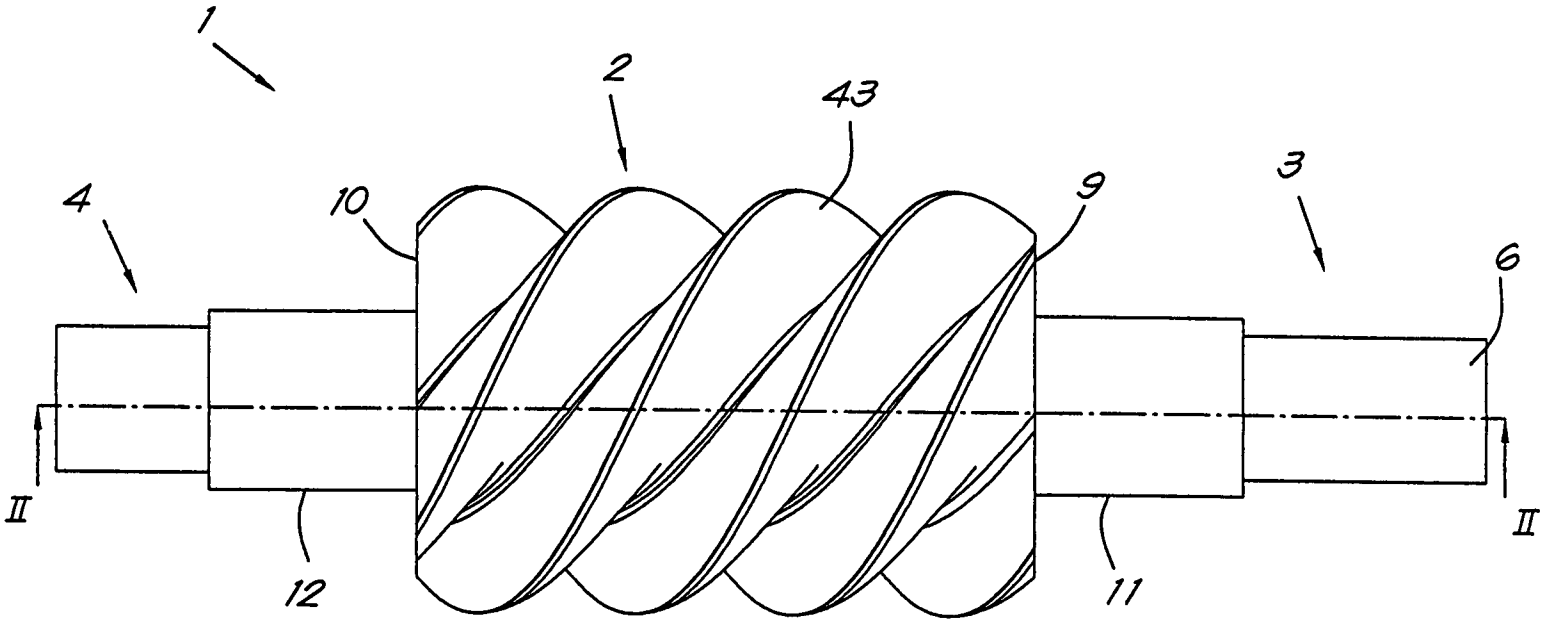
FIG. 1 schematically shows an external view of a rotor according to the invention.
Figure 2:
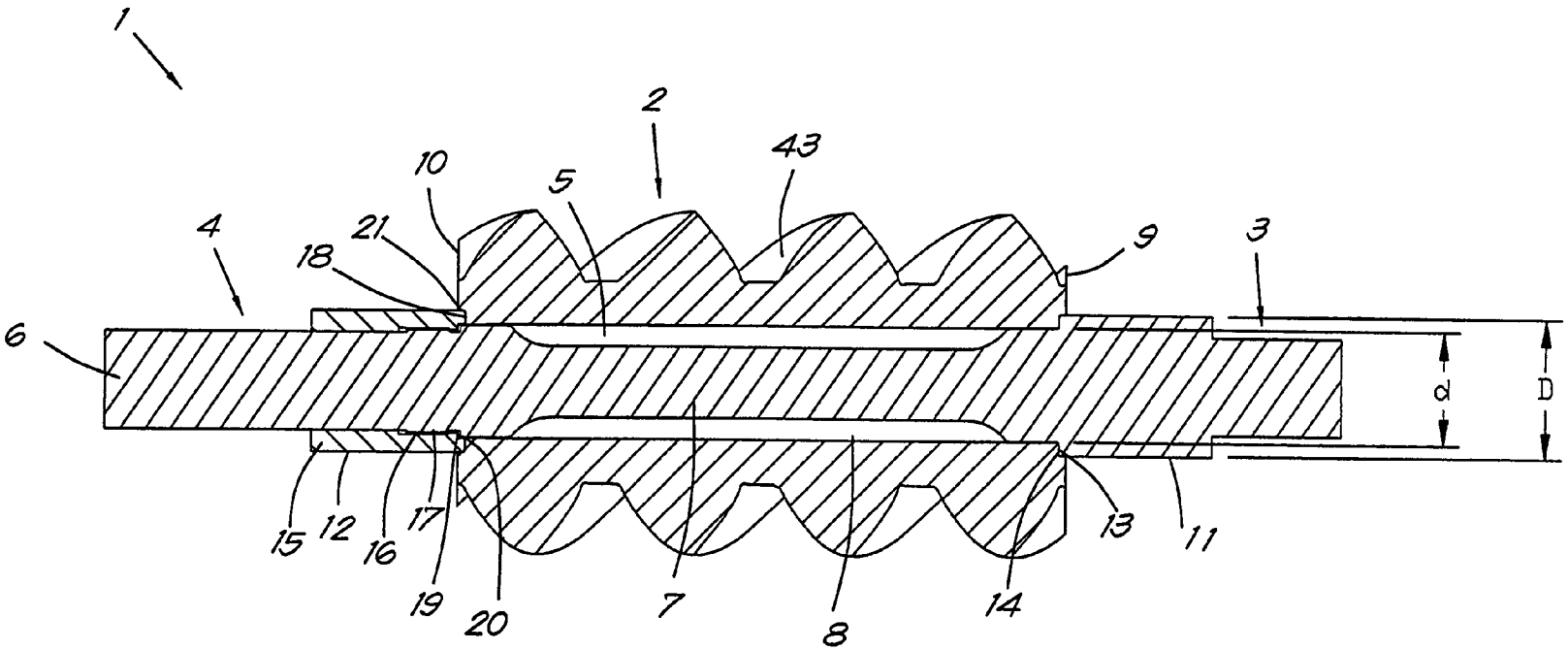
FIG. 2 shows a section according to line II-II in FIG. 1.

FIGS. 1 and 2 show a rotor 1 according to the invention for a screw compressor, whereby this rotor 1 is made in the shape of a male rotor 1 comprising a male rotor body 2 with lobes and two laterally protruding journals 3 and 4.

Hereby, the lobes of the male rotor body 2 are made such that they can co-operate with a second female screw not shown in the figures which is provided to that end with grooves in which said lobes mesh for sucking in and compressing a fluid like air.

A continuous, approximately central axial passage 5 extends through the rotor body 2, through which passage at least a part of a shaft 6 is provided.

According to the invention, said shaft 6 comprises a stretch element 7 which, in this case, forms part of the part of said shaft 6 extending through the passage 5.

Said stretch element 7 is in this case made in the shape of a reduction 8 of the diameter of the shaft 6 nearby a part of the central passage 5.

With a reduction 8 is hereby meant that the shaft 6 is provided with a waisted part or, in other words, a part of the shaft 6 having a reduced diameter.

With the expression "axial passage" is meant a passage 5 extending in a practically axial manner through the rotor body 2, however, a deviation of the direction of this passage 5 with respect to this axial direction of the rotor body 2 ranging between zero and twenty degrees is not excluded.

According to the invention, it is neither required for said axial passage 5 to be straight, though, this passage 5 can also run along a specific curved path, as long as the far ends of this passage 5 are situated on opposite sides of the rotor body 2.

Furthermore, the surface area of this passage in a plane perpendicular to the direction of the shaft 6 can have a variable size along the length direction of the shaft 6.

The rotor body 2 and the journals 3 and 4 are clamped together, such that the rotor body 2, or anyway, at least its central part, is brought under axial pressure. In this example the resulting pressure in the rotor body 2 is realized through forces acting on the end planes 9 and 10 of the rotor body 2, which forces are exerted by tension elements 11 and 12 which are interconnected by means of said stretch element 7.

According to the invention, during the manufacture of the rotor 1, this stretch element 7 is brought under tensile tension by pre-stressing, and afterwards, in its stretched state, the stretch element 7 is fixed by means of the tension elements 11 and 12.

When the rotor 1 is not built in, according to the invention, this pre-tension amounts to at least 30 percent of the yield strength of the material of the stretch element, and preferably at least fifty percent of this yield strength, and according to an even more preferred embodiment, at least seventy percent of this yield strength.

The axial forces exerted hereby on the rotor body 2 preferably amount to at least $1\times10^4$ Newton and can in practice amount up to $1\times10^6$ Newton or even more.

A first tension element 11 is provided in the shape of an increase of the diameter of the shaft 6, so as to form a collar 13. The increase in diameter of the shaft 6 is chosen such that this increased diameter D is larger than the diameter d of the central passage 5.

The collar 13 of the first tension element 11 is stretched against the end plane 9 of the rotor body 2.

In the embodiment shown, an additional recess 14 was made in the end plane 9, such that the collar 13, in an assembled rotor 1, extends in this recess 14. This recess 14 is not necessary for the invention.

A second tension element 12 is formed by a nut 15, which can be provided alongside the journal 4 over the shaft 6.

The screw thread 16 of the nut 15 cooperates with an outer screw thread 17 provided on the shaft 6 nearby the connection of the journal 4 on the rotor body 2.

In this embodiment, a recess 19 is provided in the end face 18 of the nut 15 wherein a raised edge 20 of the shaft 6 fits.

In the embodiment shown, a recess 21 was additionally made in the end plane 10 of the rotor body 2, so that said end face 18 of the nut 15 rests in this recess 21 in an assembled rotor 1.

The recess 19 of the nut 15, the recess 21 in the end plane 10 and the raised edge 20 of the shaft 6 are not necessary for the invention.

The method for manufacturing a rotor 1 according to the invention for a screw compressor is very simple and is as follows.

The shaft 6 is slid with the journal 4 through the central passage 5 in the rotor body 2, such that the collar 13 of the first tension element 11 rests against the end plane 9 of the rotor body 2, and more specifically in the recess 14.

Then the nut 15 is placed alongside the journal 4 over the shaft 6.

Then the shaft 6 is elastically or predominantly elastically stretched by means of a large externally applied force. Since the shaft 6 has a smaller diameter at the height of the reduction 8 which forms the stretch element 7, the stretching occurring in this zone will be the highest.

According to the invention, this can be done by exerting on the two ends of the shaft 6 a force with opposite direction, or by exerting a force on each journal separately by means of resting against respectively, an end plane 9 or 10 of the rotor body 2.

In this tensioned state of the shaft 6, the nut 15 is screwed down till against the rotor body 2, either by hand or with a determined torque.

When the external tensile force on the shaft 6 is removed, the rotor body 2 will be tensioned with a large axial force between the collar 13 of the shaft 6 on one hand and the end face 18 of the nut 15 on the other.

As a consequence of the tensile stresses in the stretch element 7, the tension elements 11 and 12 will exert corresponding axial forces on the rotor body 2.

To that end, the surfaces of contact between the collar 13 and the recess 14 in the end plane 9 of the rotor body 2 and between the end face 18 of the nut 15 in the recess 21 in the other end plane 10 of the rotor body 2 must be dimensioned large enough to transmit the compressive stresses to the rotor body 2.

The screw threads 16 and 17 must be dimensioned such that they can transmit to one another the axial forces, which are practically identical to the forces in the stretch element 7.

The diameter of the reduction forming the stretch element 7 is determined by the yield strength of the material from which the shaft 6 is manufactured.

The higher this yield strength, the larger the reduction (and therefore the smaller the reduced diameter as well) that can be selected to tighten the tension elements 11 and 12 against the rotor body 2 with the same force.

The Young's modulus or E-modulus determines the elongation the shaft 6 during tensioning. A larger elongation can thereby simplify the assembly. In the case of a material with a lower E-modulus, using the same tensile stress will cause a larger stretching. When the external load is removed after the assembly, in the case of a lower E-modulus, the force exerted by tension elements 11 and 12 on the rotor body 2 will vary less.

Figure 3:
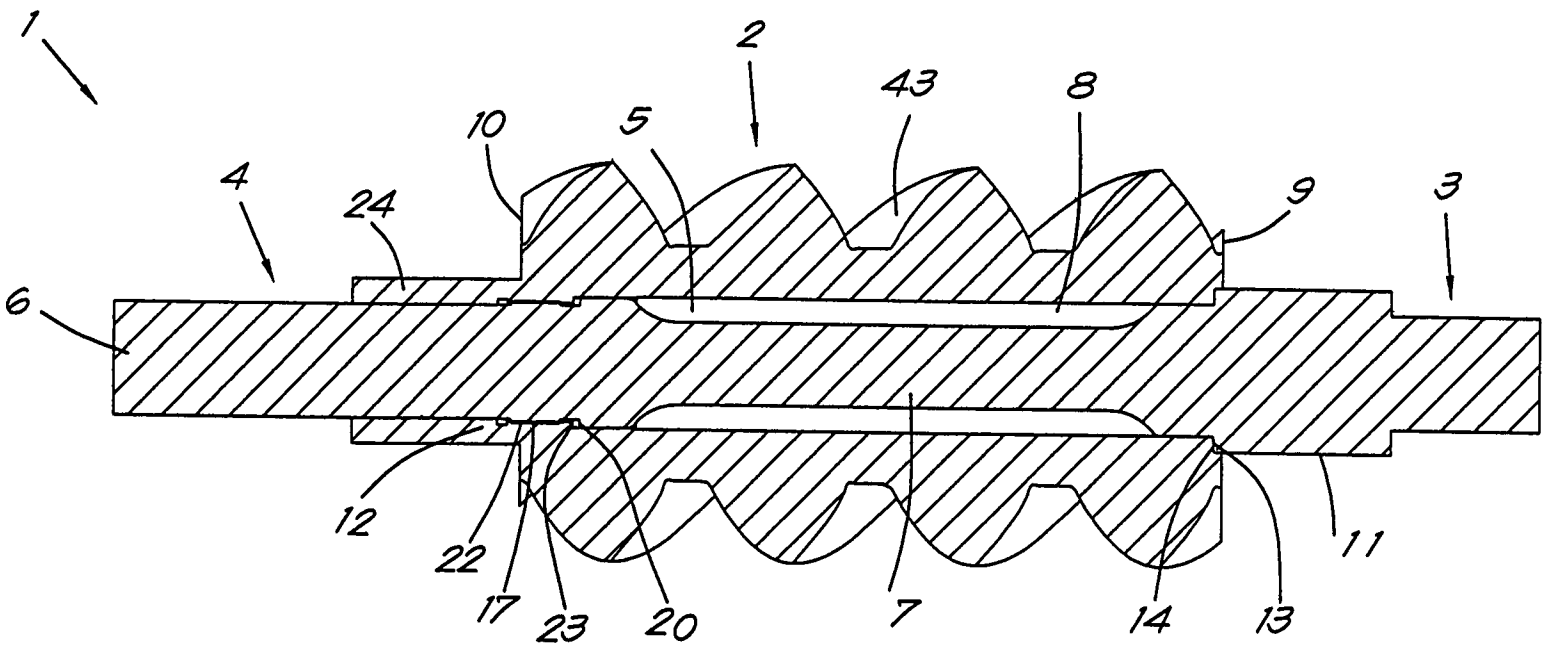
FIGS. 3 to 10 show a section similar to that of FIG. 2, but for different embodiments of a rotor for a screw compressor according to the invention.

A second embodiment, which is shown in FIG. 3, is mostly identical to the first embodiment of FIGS. 1 and 2.

Also in this embodiment, an approximately central axial passage 5 through the rotor body 2 has been provided.

Also in this case the shaft 6 integrates the functions of the journals 3 and 4, the first tension element 11 and the stretch element 7. The stretch element 7 here is also made as a reduction 8 of the shaft 6 nearby a part of the continuous central passage 5.

Though in this case, the nut, which forms the second tension element 12 in the first embodiment of FIGS. 1 and 2, is integrated in the rotor body 2.

To that end, an inner screw thread 22 is provided in the rotor body 2 at the height of the end plane 10. In assembled condition of The rotor 1 according to the invention, this inner thread 22 cooperates with the outer screw thread 17 on the shaft 6.

In this case, besides to the thread 22, an inner edge 23 is provided in the wall of the passage 5.

In the example shown, a bush-shaped part 24 is placed at the end side 10 of the rotor body 2, in the prolongation of the central passage 5, although the presence of said bush-shaped part 24 is not strictly necessary according to the invention.

The method of manufacturing a rotor 1 according to this embodiment is also very easy and similar to the method of the first embodiment.

The shaft 6 is passed through the continuous central passage 5, applied in the rotor body 2, with the journal 4, after which the shaft 6 and the rotor body 2 can be screwed down, for example, manually, using the threads 17 and 22.

Then the shaft 6 will be elastically tensioned with a large external force. The stretching condition occurring thereby is similar to that occurring in the first embodiment.

In tensioned state, the rotor body 2 is screwed down even further until the bottom wall of the recess 14 is pressed against the collar 13 of the shaft 6, after which the external force is removed.

The same observations as those made in the first embodiment must be made for the stresses and deformations that occur.

Figure 4:
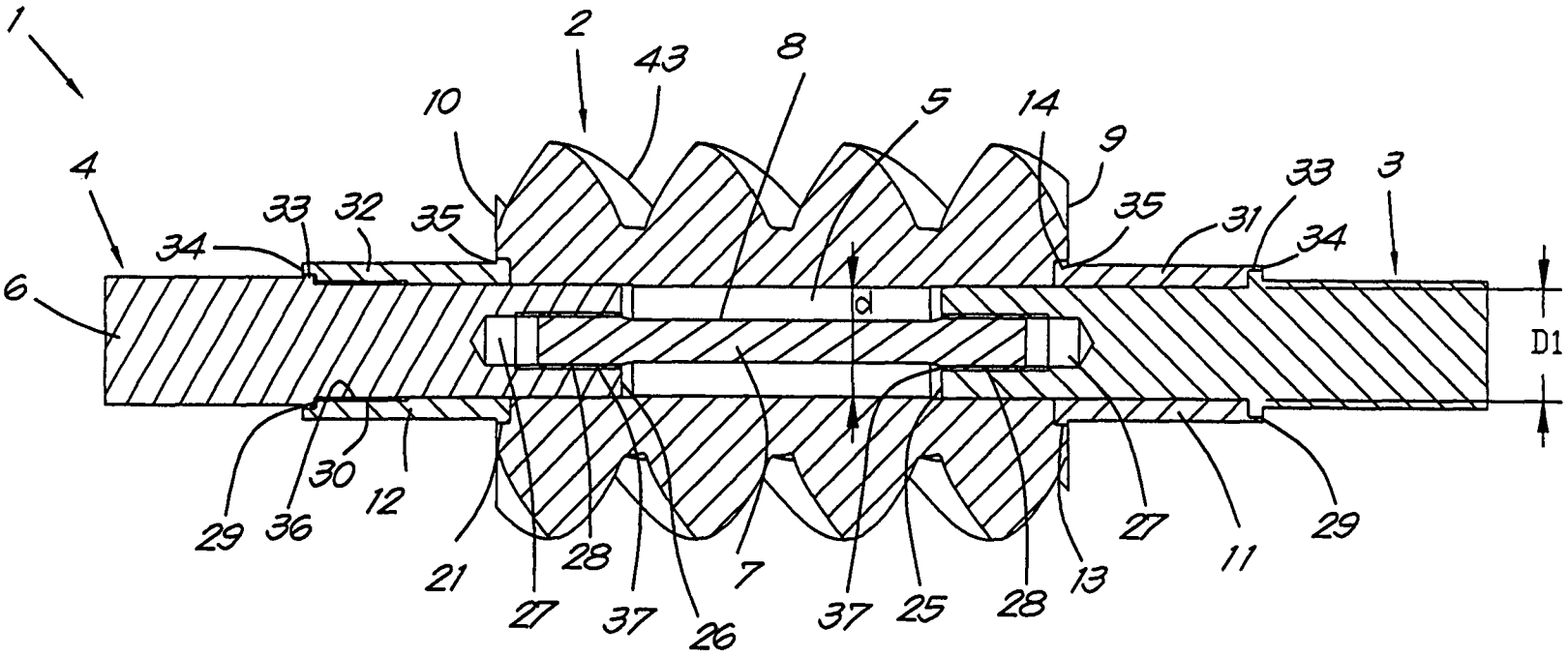

FIG. 4 shows an embodiment of a rotor 1 whereby the shaft 6 is made differently than in the first two embodiments described above.

Also in this third embodiment, the rotor body 2 is provided with an approximately central axial passage 5 through which the shaft 6 can be introduced.

To that end, and if desired, recesses 14 and 21 are made in the end planes 9 and 10 of the rotor body 2.

In this case, the shaft 6 is made as a composite component, consisting of the journals 3 and 4 and a stretch element 7.

The journals 3 and 4 are preferably made as cylindrical-shaped parts.

These journals 3 and 4 have at their end planes 25 and 26 a diameter D1 which is somewhat smaller than the diameter d of the continuous central passage 5.

Central, non-through bored holes 27, or so-called blind holes, are made in these end planes 25 and 26. Eventually, these bored holes 27 have an inner screw thread 28. These bored holes 27 may be made as through bored holes such that these could extend through respectively, journal 3 or 4.

Collars 29, which can also be made as raised edges, are located on the journals 3 and 4 at a certain distance from the end planes 25 and 26.

On at least one of the journals, and in this case on the journal 4, an outer screw thread 30 is applied in the zone between the collar 29 and the end plane 26 on the external surface of the shaft 6.

In this example, the tension elements 11 and 12 are made as sleeves 31 and 32 with an inner diameter which is somewhat larger than the diameter of the journals 3 and 4 between the collars 29 and the end planes 25 and 26.

These sleeves 31 and 32 can possibly be provided with a recess 33 in the end planes 34. In that case, the diameter of this recess 33 could be chosen corresponding to the collar 29 on the journals 3 and 4.

Further, it is possible to provide the sleeves 31 and 32 at the opposite transverse end of an additional collar 35. In that case, the height of this collar 35 is determined such that the diameter at the height of this collar 35 coincides with the recess 14 or 21, respectively, of the rotor body 2.

It is clear that possibly one of the sleeves 31 or 32 can be integrated in a journal 3 or 4.

In at least one of the tension elements, and in this case in the tension element 12, an inner screw thread 36 is provided, which screw thread 36 can cooperate with the outer screw thread 30 on the journal 4.

In this case, the stretch element 7 is made as an approximately cylindrical body having an outer screw thread 37 at both ends.

The dimensions of the stretch element 7 are established such that the outer threads 37 on both sides of the stretch element 7, can cooperate with the inner threads 28 in the central bored holes 27 which are made, respectively, in the end planes 25 or 26 of the journals 3 and 4.

Also for this embodiment, the method of assembling a rotor 1 for a screw compressor is very easy and as follows.

The stretch element 7 is connected to one of the journals 3 or 4, for example to journal 3. This is done by screwing one of the outer screw threads 37 into the inner screw thread 28 in the central bored hole 27 of the journal 3 concerned.

The sleeve 31 is placed over the journal 3. If a recess 33 was made in the sleeve 31, this recess 33 will rest against the collar 29 of the journal 3. If no recess 33 was made, the sleeve 31 may rest against the collar 29 with its end face 34.

This assembly of the stretch element 7 with the journal 3 and the sleeve 31 is introduced, together with the stretch element 7, through the continuous central passage 5 in the rotor body 2 such that the raised edge 35 of the sleeve 31 rests against the end plane 9 of the rotor body 2 in the recess 14.

The sleeve 31 with its corresponding end plane can possibly rest directly against the end plane 9 of the rotor body 2 if there is no recess 14.

The sleeve 32 is then placed over the journal 4. If a recess 33 was made in the sleeve 32, this recess 33 will then rest against the collar 29 of the journal 4. If the recess 33 was not made, the sleeve 32 could rest with its end face 34 against the collar 29. However, the presence of such collar 29 is not strictly required according to the invention.

The journal 4 with the sleeve 32 thus placed will then be connected to the assembly of the stretch element 7 with the journal 3 and the sleeve 31.

To that end, the inner thread 28, which is located in the central bored hole 27 of the journal 4, is screwed down on the outer screw thread 37 of the stretch element 7.

Thereupon, the composite shaft 6 is elastically tensioned with a large externally applied force.

In tensioned state, the sleeve 32 is screwed down.

When the external tensile force on the composite shaft 6 is removed, the raised edge 35 of the sleeve 31 will be situated in the recess 21 of the end plane 10 of the rotor body 2. The recess 33 in the sleeve 31 will rest against the collar 29 of the journal 3.

The other sleeve 32 will be situated with its raised edge 35 in the recess 21 in the end plane 10 of the rotor body 2. The recess 33 in the sleeve 32 will be located against the collar 29 of the journal 4.

As a consequence of the tensile stresses in the stretch element 7, the tension elements 11 and 12, here mainly shaped by the sleeves 31 and 32, will exert corresponding axial pressure forces on the rotor body 2.

This embodiment offers the advantage that the material of the stretch element 7 can be chosen independently from the material of the journals 3 and 4 and from the material of the rotor body 2.

As mentioned already above, a greater elongation of the stretch element 7 during stress will facilitate the assembly. This can be obtained by means of a suitable choice of material for the stretch element 7. By choosing, for example, a material with a lower E-modulus or a higher yield strength, applying the same tensile stress will cause a larger stretching.

When the external load is removed after the assembly the force exerted by the tension elements 31 and 32 on the rotor body 2 will also vary less in this case.

In this case, the journals 3, 4 themselves can be made from a more rigid material, thus with a higher E-modulus.

Figure 5:
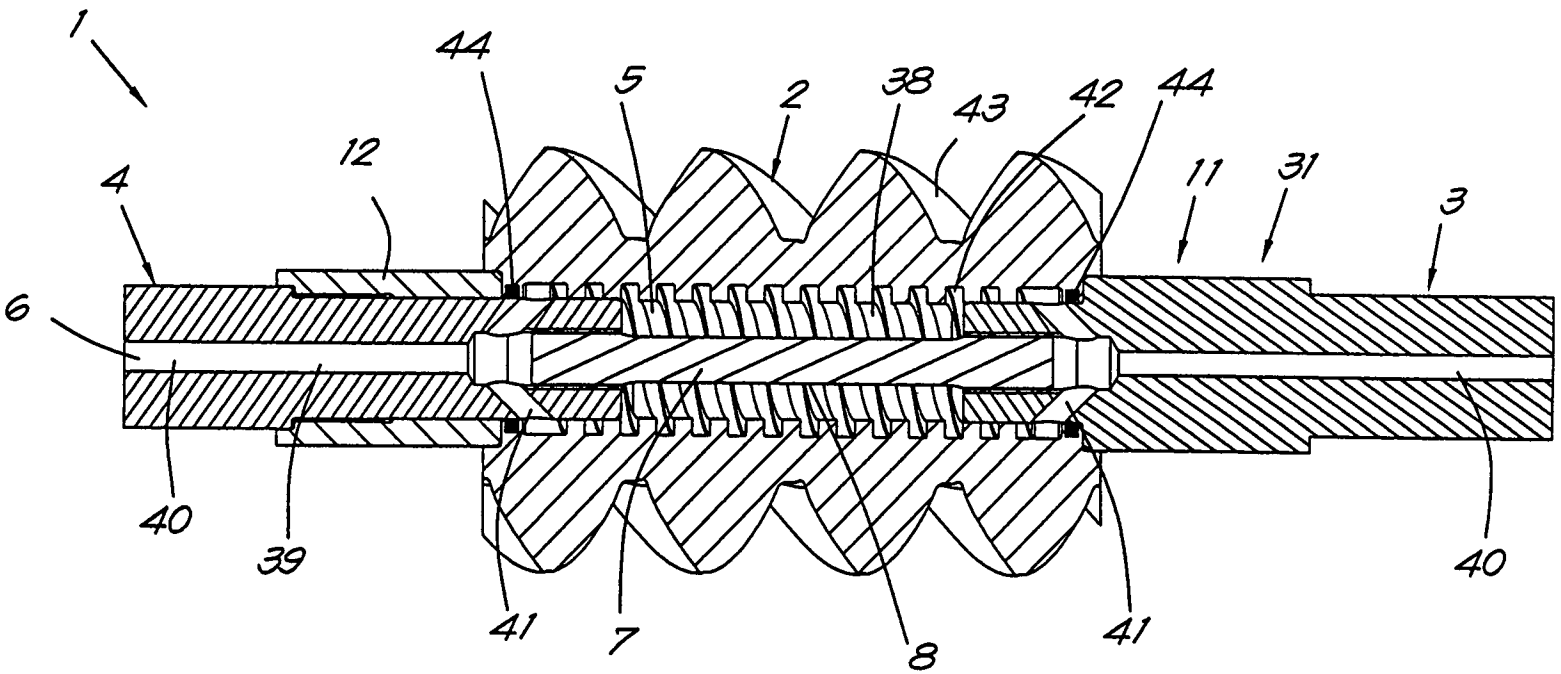

FIG. 5 shows how the embodiment of FIG. 4 can be modified to solve the problems indicated above in view of cooling the rotor 1.

The assembly and the method for mounting of this embodiment variant are similar to those of the embodiment shown in FIG. 4, although in this case the sleeve 31 is integrated with the journal 3.

Since the cross-section of the stretch element 7 is smaller than the cross-section of the aforementioned central axial passage 5, there remains a cavity 38 between the shaft 6 and the rotor body 2 when the rotor 1 is assembled.

In the defined embodiment, said cavity 38 forms part of a cooling channel 39 for guiding a coolant through the rotor 1.

This cooling channel 39 also comprises bored holes 40 which are made in the respective journals 3 and 4 of the shaft 6 and which are connected to said cavity 38 through one or more inner branches 41 of these bored holes 40, and in this case also through a part of a helical groove 42 in the circumferential wall of said axial passage 5, which part extends between the rotor body 2 and a part of a journal 3 or 4, respectively, extending in said passage 5.

Said helical groove 42 extends practically in the axial direction of the aforementioned axial passage 5 and forms a flow-through channel for a coolant.

A coolant can flow into the rotor 1 through a bored hole 40 in one of the journals 3 or 4, and after flowing through the rotor body 2, will flow out through the bored hole 40 in the other journal 4 or 3.

Since the compression heat of the fluid at the height of the external surface 43 is transferred to the rotor body 2, the coolant shall preferably flow as close as possible to the external surface 43 to obtain a cooling as optimal as possible.

This can be achieved, for example, by making the diameter of the cooling channel 39 as large as possible, for example by making said helical groove 42 in the wall of this axial passage 5.

Since the rotor body 2 and the journals 3 and 4 can be manufactured separately in this embodiment, the diameter of the cooling channel 39 can be easily adapted, especially by making the diameter at the height of the journals 3 and 4 smaller than the diameter of the central axial passage 5 in the rotor body 2.

Because of this, it is achieved that the outer diameter of the journals 3 and 4 can remain limited, such that it has a minimal effect on the strength of these journals 3 and 4 and such that the bearings must also have only limited dimensions. On the other hand, as a result of the relatively larger diameter of the axial passage 5, it is achieved that the inner cooling of the rotor body 2 is brought to the outer surface, which improves the efficiency of this cooling.

Since in this case the rotor 1 is a composite rotor, said cooling channel 39 can be constructed in a relatively easy way, while in the case of a single-piece rotor this is significantly more difficult.

Optionally the rotor 1 can be provided with additional sealing means 44 to prevent coolant leaking out into the compression room of the screw compressor.

These additional sealing means 44 could be provided in the rotor body 2 itself or at the height of the tension elements 11 and 12 and they could be, for example, in the form of glue, O-rings or the like.

In view of improving the efficiency of the inner cooling, it can be chosen to create a turbulent flow of coolant through the cooling channel 39. To that end additional means not shown in the figures can be provided in the cooling channel 39 which create turbulence in the coolant or which reinforce the existing turbulence. These additional means could consist of, for example, elements in the shape of blades or other elements affecting the flow, which are arranged in the flow and on the shaft 6 or inside the material of the rotor body or forming a part thereof.

The manufacturing of a rotor 1 according to FIG. 5 is similar to that of the one shown in FIG. 4, as described above.

The use of an inner cooling of the rotor body 2 is especially suited for application in an oil-free compressor, whereby no coolant is injected in the compression room, though, of course, such cooling can also be applied in a liquid-injected screw compressor as well.

Figure 6:
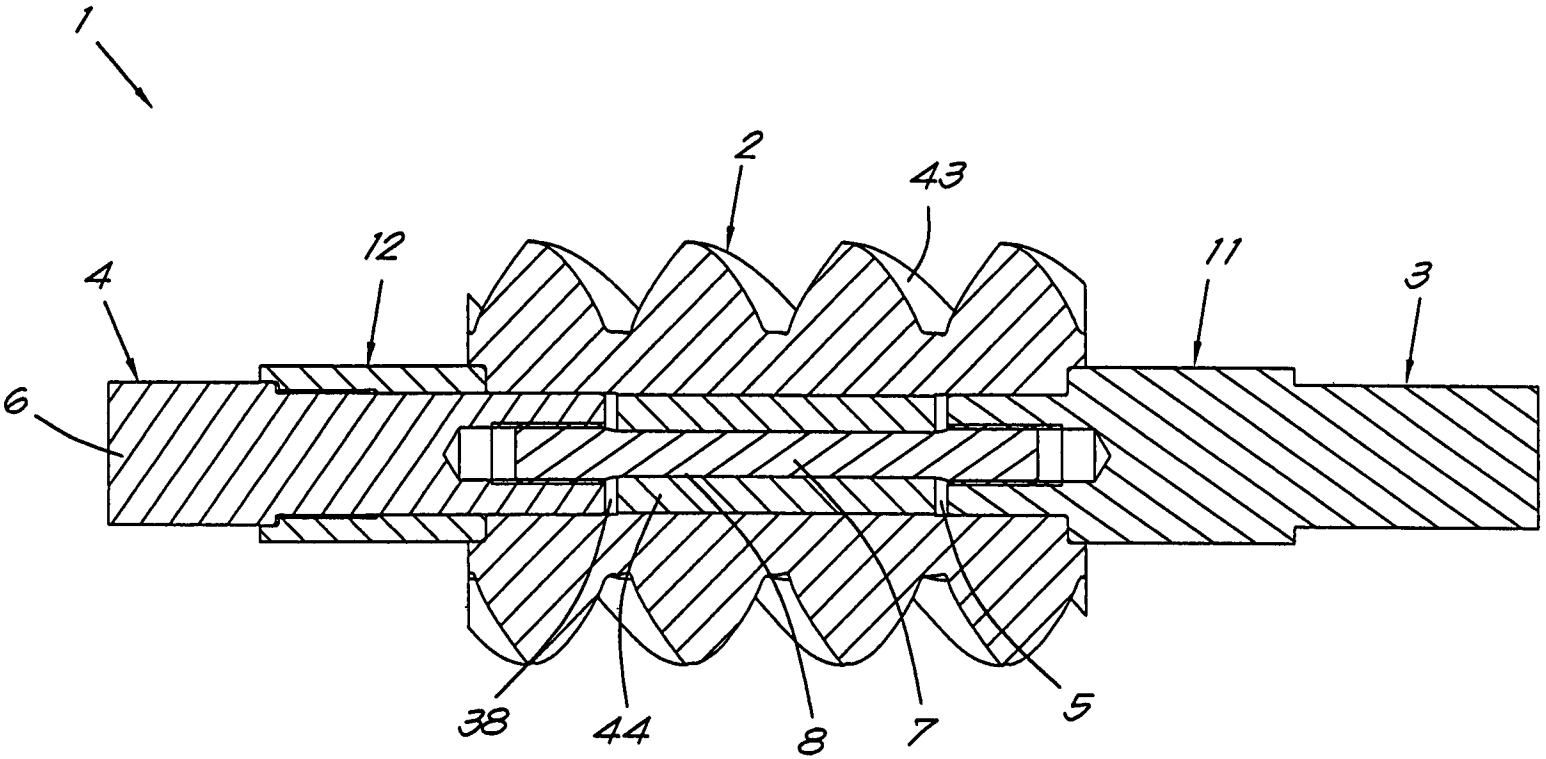

In the embodiment shown in FIG. 6, a part of the cavity 38 is completely or partially filled with a filler element 45 or filler material. This filler element 45 or filler material could be chosen such that, the coolant is guided better in the groove or grooves 42 in view of achieving a more efficient cooling.

By means of a well-founded determination of the dimensions and of the material from which this filler element 45 is made, it is possible to influence different characteristics of the rotor 1 in a positive way.

Hence, the dimensions and the material of the filler element 45 can be determined such that the characteristic frequency of the rotor 1 shifts towards a desired value.

By modifying the features of the filler element 45, it is also possible to dampen the vibrations of the rotor in the screw compressor with a desired damping factor.

In another application, the features of the filler element 45 can be determined to achieve a rotor 1 with a desired rigidity.

By means of a suitable choice of the material, a filler element 45 can be manufactured which, by means of expansion or shrinkage, allows the size of the inner cooling channel to change. By means of a combination of different materials in the mixed form or discontinuously dispersed, the filler element 45 can influence the properties of the cooling channel in an aimed way and this influencing can be locally different depending on the location in the axial and/or radial direction of the rotor 1.

In general, it is also possible to apply a texture and/or external shape on the external surface of the filler element 45 which can influence the cooling and/or flow of the coolant in a particular way. Furthermore, this texture and/or shape can change along the circumference of the filler element 45, both in the axial and in radial directions of the rotor 1.

The cavity 38 also offers the advantage of providing space to place sensors in the rotor body 2. These sensors can be used, for example, to monitor vibrations or temperature.

Again, the manufacturing of said rotor 1 according to FIG. 6 is similar to the embodiments shown in the previous FIGS. 4 and 5.

Figure 7:
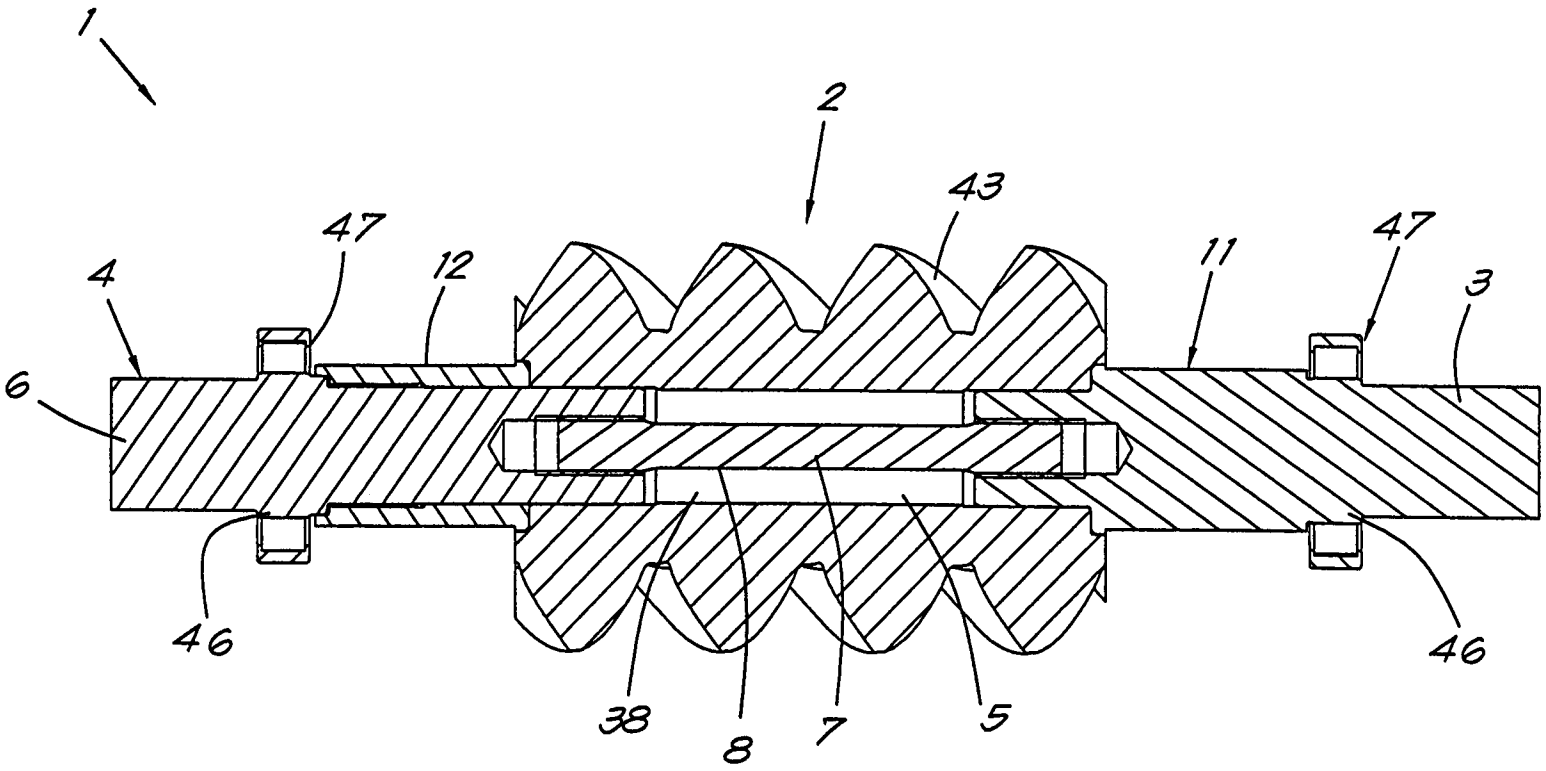

FIG. 7 shows an embodiment of a rotor 1 according to the invention, whereby, in this case both inner rings 46 of a bearing 47 with rolling elements are integrated in the respective journals 3 and 4 of the rotor 1. According to the invention, it is also possible that just one of the journals 3 or 4 has an integrated inner ring 46.

These inner rings 46 are preferably made in the shape of a local increase of the diameter of the journal 3 respectively 4, such that the other components of the bearing can be mounted more easily at their place.

It is possible to obtain this additional advantage since the journals 3 and 4 are made as separate, smaller components. Such smaller components make it possible to be manufactured from materials suitable for being used as a bearing 47 and to finish these journals 3 and 4 in a special manner, so that the journals 3, 4 can be used as an inner ring 46 of the bearing 47.

This offers not only the advantage that fewer components and less material should be used, but also allows to obtain a more rigid assembly with a smaller bearing diameter, such that the energy losses are further reduced, and whereby it is even possible to allow the rotor 1 to rotate at a higher number of revolutions.

Figure 8:
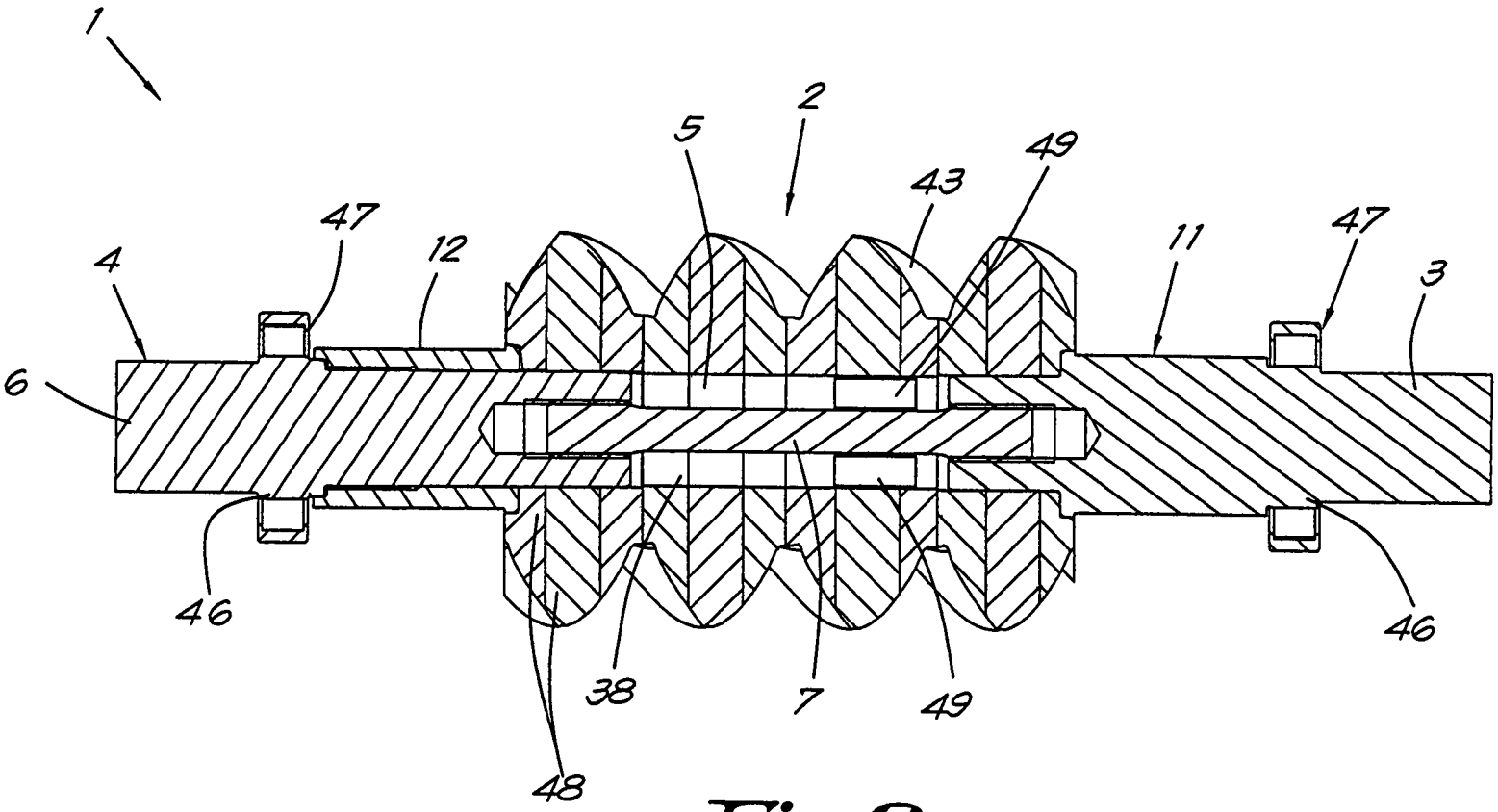

In yet another embodiment, shown in FIG. 8, the rotor body 2 itself can be composed of different composing parts called segments 48. These segments 48, when arranged parallel one to another, form together a rotor body 2.

Preferably, the segments 48 are held together by the compression forces exerted by the tension elements 11 and 12 or, in an alternative embodiment, additional mechanical means can be provided for additionally connecting segments with each other.

The different segments 48 of such composite rotor body 2 can have, for example, a different rotor speed or a different rotor profile, or they can be manufactured from different materials or from the same materials subjected to different treatments.

In that case it is possible to take into account a desired difference in temperature conductivity along the longitudinal direction of the rotor body 2, or a variable material strength along the length of this rotor body, for example.

As such it is possible to choose the most suitable material for each segment 48, taking into account thereby the cost of the material, the temperature resistance, the tribological properties, the coefficient of expansion and the desired insulating or conducting properties.

According to a particular feature of the invention, one or more of the different segments 48 of the rotor 1 can be provided with a different coating, or only certain segments 48 can be coated although other segments can be uncoated, and this based on the requested requirements of the rotor 1 at different locations along its longitudinal direction.

In the latter case, coating consumption is reduced and moreover a reduction of the solvent emission during coating is obtained, such that the service life of the filters and activated carbon in the possible spraying chambers in which the coating is applied can be substantially increased with respect to the coating of the same amount of single-piece rotors.

Said coatings can consist of, for example, of a non wear proof layer which optimizes the meshing of respective rotors in a screw compressor element and thus reduces internal leakage losses.

The coating can also be chosen such that direct contact between moving parts is allowed.

According to the invention, it is also possible to not coat the individual shaft 6, such that the production time of a rotor is reduced and problems and implications resulting from the coating process as well as possible finishing processes are avoided.

It is also possible to provide a texture on the external surface 43 of certain segments 48 in order to obtain the growth of a fluid film during the operation of the screw compressor, while on other segments 48 such texture is not applied or another texture is applied.

In particular, the application of such texture on one or both outer segments 48 of the rotor 1, and more specifically on the end plane thereof, can be considered.

If desired, the outer diameter of the different segments 48 can also be varied, taking into account the expected thermal expansion of a rotor 1 when mounted in the screw compressor.

The composite rotor 1 that is finally obtained can also be coated in its entirety if desired. The same also applies to the previously described embodiments of rotors 1 which are within the scope of the invention.

The features of the embodiments described as an example could be combined with one another to obtain other embodiments, which other embodiments also fall within the scope of the invention.

In the described embodiments screw connections are used as connection means. However, these connections can also be realized in a different manner. Some examples are the use of pin—pin hole connections, wedge—wedge hole connections or as a fitting sleeve, for example.

The tension elements 11 and 12 can also be anchored with respect to the shaft 6 by means of welding, brazing, shrink-fitting, soldering them in their final position, or the like.

The different parts of the rotor 1 can be made from different materials or from a single material with different treatments. The different components can also be made from a combination of materials.

In the previous embodiments, a single stretch element 7 has always been described, but it is clear that the invention is not limited as such since several stretch elements 7 placed in parallel or in series can also be used.

It is clear that in all the embodiments a sensor 49 can be installed in the space 38 between the stretch element 7 and the rotor body 2, as shown in FIG. 8, for example to measure the vibrations, temperature or the like.

According to the invention, it is possible that one of the tension elements 11 or 12 is an integral part of the rotor body 2.

Figure 9:
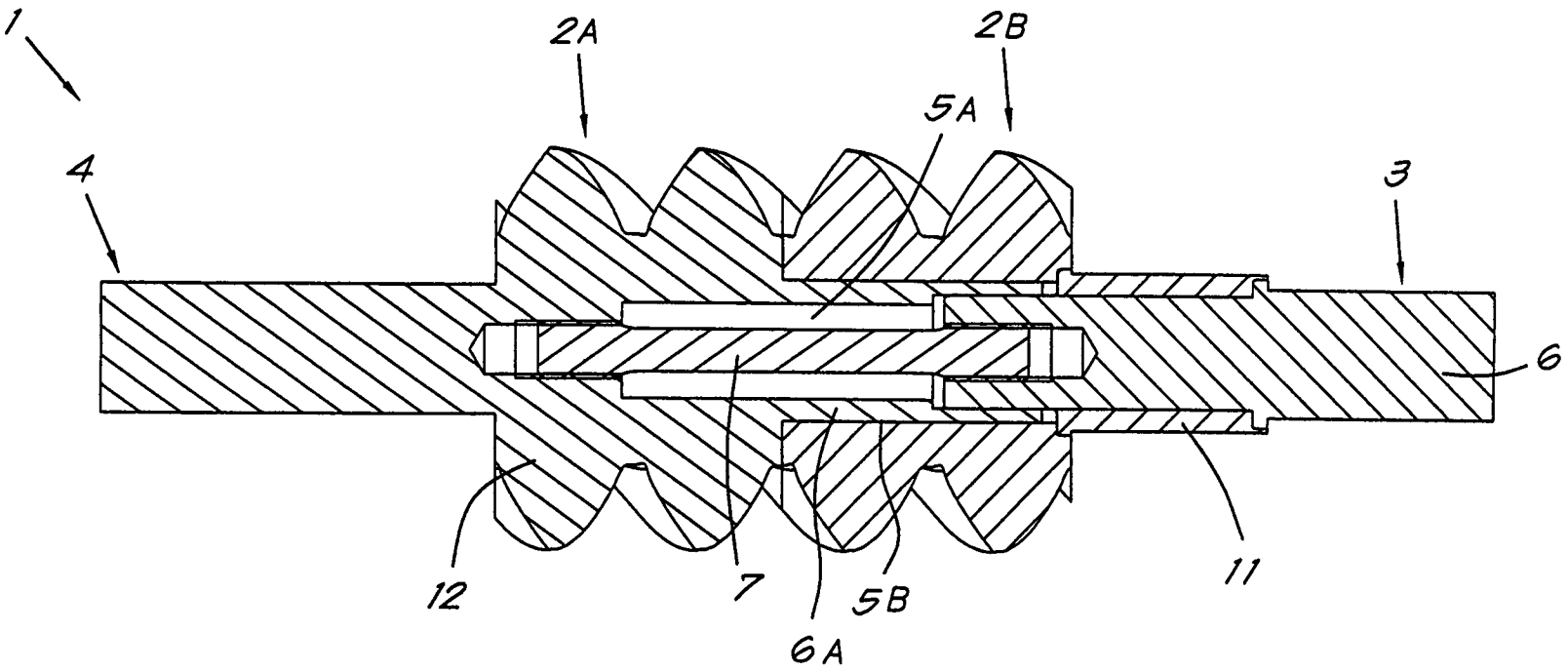

An example thereof is shown in FIG. 9, which shows a rotor 1 with a rotor body 2 that is composed of two parts 2A and 2B and whereby part 2A is formed as a whole with a part 6A of the shaft 6 and the journal 4, and whereby the part 2A of the rotor body 2 is made as a part with a diameter larger than the central passage 5B through the part 2B of the rotor body 2.

The part 2A of the rotor body 2 and the part 6A of the shaft 6 integrated therein, have a central bored hole 5A in which the stretch element 7 extends, which is at one end screwed in the bored hole 5A of the journal 4 and with the other end screwed on the journal 3 which is axially displaceable in the boring 5A, in which the stretch element 7 remains pre-tensioned by the tension elements 11 and 12 which are made as a screw bushing screwed on the journal 3 on one hand, and as the part 2A of the rotor body 2 on the other, and which are kept separated by the part 2B of the rotor body 2.

Figure 10:
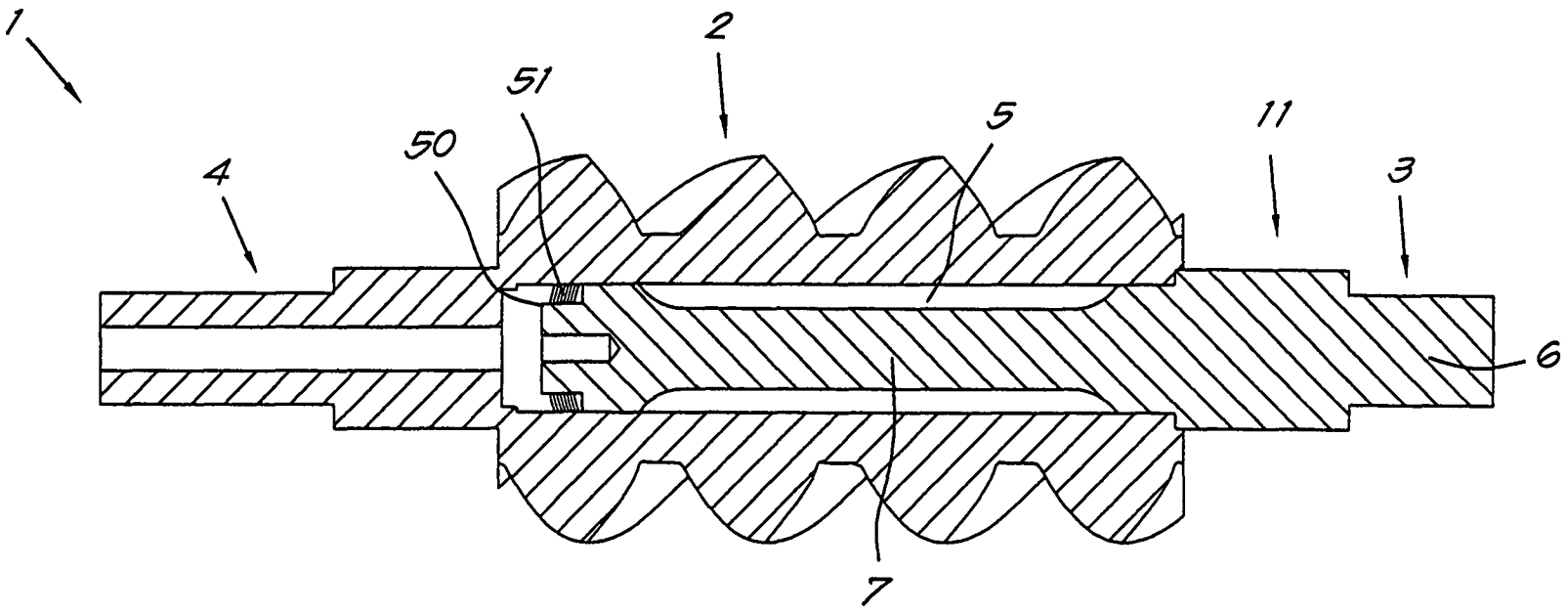

FIG. 10 shows yet another variant of a rotor 1 according to the invention, whereby in this case the journal 4 is made as an integrated part with the rotor body 2 which is provided with an axial central bored hole 5.

The stretch element 7 is provided as a reduction of the shaft 6 which partially extends in the bored hole 5 and which at the end located in the bored hole 5 is provided with a constricted cylindrical part 50 with a smaller diameter than that of the bored hole 5 and whereon one or more fixing elements in the shape of deformable elements such as star washers 51 or the like are arranged which are clamped between the shaft 6 and the inner wall of the bored hole 5. Thus, at least one of said tension elements may be a deformable snapping element arranged between an end of the stretch element and the central or approximately central axial bored hole in the rotor body.

Figure 11:
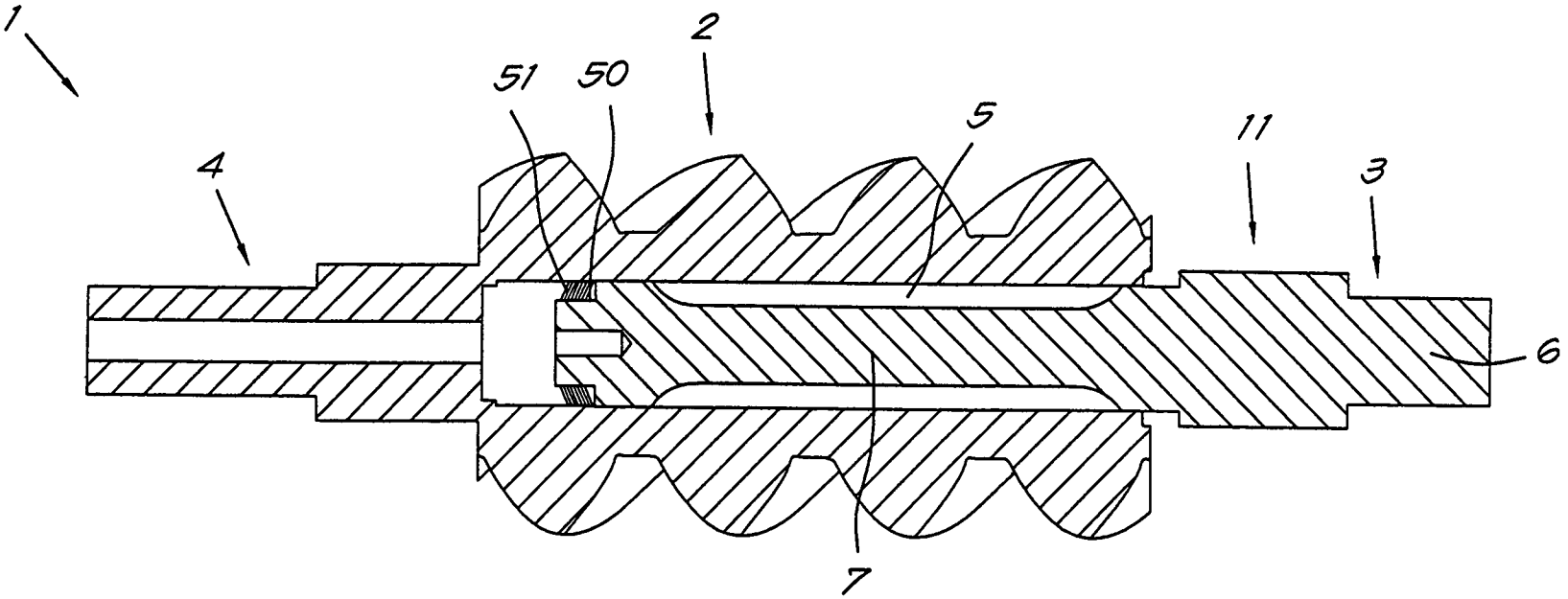
FIG. 11 shows the rotor of FIG. 10 during assembly.

These star washers 51 have an outer diameter which is somewhat larger than the diameter of the bored hole 5 and are placed in a oblique manner, as shown in FIG. 11, at the narrowed end 50.

During the assembly, the rotor body 2 with its bored hole 5 is slid onto the stretch element 7 until the rotor body 2 touches the tension element 11, after which the stretch element 7 is placed under the pre-tension of a tensile force by means of stretching the stretch element 7 somewhat.

The tensile force can then be removed, such that the stretch element 7 will tend to relax again and consequently will have the tendency to pull the star washers 51 back from the bored hole in the direction of the journal 3.

However, due to the oblique placement of the star washers 51, the latter will resist this movement in the direction of the journal 3 and these star washers 51 will slightly draw up, as shown in FIG. 10, and will clamp between the cylindrical part 50 of the stretch element 7 and the central bored hole 5.

The star washers 51 behave as if they were hooks that prevent the removal of the stretch element 7 from the bored hole 5, whereby these star washers provide an axial locking or blocking of the end 50 with respect to the rotor body 2, and accordingly, are in charge of keeping at least a part of the rotor body 2 pre-tensioned.

The present invention is by no means limited to the embodiments described as an example and shown in the drawings, but a rotor 1 for a screw compressor according to the invention can be made in many shapes and dimensions without going beyond the scope of the invention.

The invention claimed is:

1. A method for manufacturing a rotor comprising the steps:

providing a central or approximately central axial bored hole or passage in a rotor body;

mounting in the bored hole at least part of a shaft comprising a stretch element;

loading the stretch element under tensile stress in order to pre-stress the stretch element;

providing tension elements on both sides of the stretch element, said stretch element connecting the tension elements with each other, and which tension elements are locked or are lockable axially with respect to the shaft in such position that, after removing the tensile load, they are separated by the rotor body or a part thereof, and the tension elements maintain the stretch element under pre-tension.

2. The method according to claim 1, wherein said tensile stress is such that after removing the tensile stress, the stretch element is maintained under an axial pre-stressing which, before the rotor is built in, amounts to at least thirty percent of the yield strength of the material of the stretch element.

3. The method according to claim 1, wherein the tensile load is such that after removing the tensile load, the stretch element is maintained under axial pre-tension of at least fifty percent of the yield strength of the material of the stretch element.

4. Rotor for a screw compressor, comprising:

a rotor body and a shaft having a pair of opposed journals, wherein the journals are located on opposite axial ends of the rotor;

said shaft extending at least partially into or through a central or approximately central axial bored hole or passage in said rotor body;

said shaft comprising a stretch element;

said rotor body or at least a part thereof being held on the shaft by tension elements which are locked or lockable axially with respect to the shaft and which are connected with each other by said stretch element;

said stretch element, during the mounting of the rotor body on the shaft, being pre-tensioned by a tensile load and after locking said tension elements and removal of the tensile load, is kept under an axial pre-tension which, before the rotor is built in, amounts to at least thirty percent of the yield strength of the material of the stretch element;

said tension elements being held apart from each other by the rotor body or a part thereof;

wherein the rotor body and the journals are clamped together by means of the stretch element such that the rotor body, or at least a part thereof, is brought under axial pressure.

5. Rotor according to claim 4, wherein, after removal of the tensile load, said stretch element is maintained under axial pre-tension of at least fifty percent of the yield strength of the material of the stretch element.

6. Rotor according to claim 4, wherein, in the assembled state of the rotor body and shaft, a cavity is provided between the shaft and the rotor body.

7. Rotor according to claim 6, wherein said cavity comprises a cooling channel arranged to guide a coolant through the rotor.

8. Rotor according to claim 7, wherein said cooling channel comprises bored holes which are provided in the journals of the shaft and which are in connection with said cavity by one or more inner branches.

9. Rotor according to claim 7, including seals arranged to seal the cooling channel relative to the rotor body.

10. Rotor according to claim 9, wherein said seals are provided in the rotor body.

11. Rotor according to claim 9, wherein said seals are provided near the tension elements.

12. Rotor according to claim 6, wherein at least one sensor is provided in said cavity.

13. Rotor according to claim 4, including a helical groove provided in a wall of the central or approximately central axial passage which extends in the axial direction and which defines a flow-through channel for a coolant.

14. Rotor according to claim 4, wherein at least a part of said cavity is filled with a filler element and/or filler material.

15. Rotor according to claim 14, wherein dimensions and material of said filler element and/or filler material are selected to shift the characteristic frequency of the rotor to a selected value.

16. Rotor according to claim 14, wherein the dimensions and the material of said filler element and/or filler material are selected to effect a desired damping factor for the rotor vibrations.

17. Rotor according to claim 14, wherein dimensions and material of said filler element and/or filler material are selected to effect a desired rigidity of the rotor.

18. Rotor according to claim 4, wherein the rotor body comprises several parts or segments and said parts or segments have a different rotor pitch.

19. Rotor according to claim 4, wherein said rotor body comprise at least two rotor parts and said at least two rotor parts are made of a different material or of the same material that has been subjected to different treatments.

20. Rotor according to claim 4, including an inner ring of a bearing with rolling elements integrated in one or both journals of the shaft.

21. Rotor according to claim 4, wherein the magnitude of the tensile forces in the stretch element and of corresponding compressive forces exerted by the tension elements on the rotor body amount to at least $1\times10^4$ Newton.

22. Rotor according to claim 4, wherein the stretch element has the shape of a reduction which is applied over a part of the shaft.

23. Rotor according to claim 4, wherein the stretch element comprises a separate part which has a connection device at each end for connecting the stretch element with a respective journal of the shaft.

24. Rotor according to claim 23, wherein the connection device comprises an outer screw thread provided on the stretch element which cooperates with an inner screw thread which is provided in a central bored hole at a respective journal of the shaft.

25. Rotor according to claim 23, wherein the connection device comprise a pin, a pin hole, a wedge, a wedge recess and/or a fitting sleeve which cooperates with a corresponding connection device at a corresponding journal of the shaft.

26. Rotor according to claim 4, wherein said tension elements comprise a bush on one side having a selected thickness; said bush being arranged between a respective end plane of the rotor body and a raised edge on a respective journal of the shaft.

27. Rotor according to claim 4, wherein at least one of the tension elements comprises a nut mounted on a journal; a screw thread of the nut cooperating with an outer screw thread on the journal at its connection with the rotor body; the end face of the nut resting against an end plane of the rotor body; and said nut being screwed on the corresponding journal, so that the nut engages a raised edge on a journal of the shaft.

28. Rotor according to claim 27, wherein one or both tension elements are fixed with a pin, a wedge or a fitting sleeve which cooperate with a hole or groove.

29. Rotor according to claim 27, wherein one or both tension elements are fixed by welding, brazing, soldering or shrink-fitting them in their final position.

30. Rotor according to claim 4, wherein at least one of said tension elements has the shape of an outer screw thread provided on a corresponding journal which cooperates with an inner screw thread of the rotor body.

31. Rotor according to claim 4, wherein at least one of said tension elements is a deformable snapping element arranged between an end of the stretch element and the central or approximately central axial bored hole in the rotor body.

32. Rotor according to claim 4, wherein at least one of said tension elements comprises part of the rotor body formed integral in one piece with the shaft.

* * * * *